US005585908A

United States Patent [19]

Rakov et al.

[11] Patent Number: 5,585,908

[45] Date of Patent: Dec. 17, 1996

[54] IMAGE FORMING APPARATUS USABLE WITH VARIABLE WIDTH RECEIVERS

[75] Inventors: David M. Rakov, Rochester; Thomas N. Tombs, Brockport, both of N.Y.

[73] Assignee: Eastman Kodak Company, Rochester, N.Y.

[21] Appl. No.: 381,670

[22] Filed: Jan. 31, 1995

[51] Int. Cl.[6] ..... G03G 15/16

[52] U.S. Cl. ..... 355/274; 355/311

[58] Field of Search ..... 355/208, 271, 355/274, 311

[56] References Cited

U.S. PATENT DOCUMENTS

| | | | |
|---|---|---|---|
| 3,837,741 | 9/1974 | Spencer | 355/274 |
| 3,924,943 | 12/1975 | Fletcher | 355/274 |
| 4,610,530 | 9/1986 | Lehmbeck et al. | 355/311 |
| 5,036,360 | 7/1991 | Paxon et al. | 355/208 |
| 5,084,737 | 1/1992 | Hagen et al. | 355/274 |
| 5,099,287 | 3/1992 | Sato | 355/274 |
| 5,455,664 | 10/1995 | Ito et al. | 355/311 X |

*Primary Examiner*—William J. Royer
*Attorney, Agent, or Firm*—Leonard W. Treash

[57] ABSTRACT

A toner image is transferred from an image member to a receiving sheet using a backing member or corona charger to which a constant current source is applied for creation of a transfer electrical field. A logic and control receives an input indicative of the width of the receiving sheet and adjusts the current applied by the constant current source accordingly. Preferably, the logic and control also has an input indicative of the resistance of the receiving sheet, for example, determined by determining relative humidity and/or the thickness of the receiving sheet, which also is used with the width input to adjust the current applied by the constant current source.

9 Claims, 3 Drawing Sheets

IMAGE FORMING APPARATUS USABLE WITH VARIABLE WIDTH RECEIVERS

This invention relates to image forming apparatus usable with receiving sheets of variable crosstrack dimension. More specifically, it relates to an improved transfer station for transferring a toner image to receiving sheets of varying crosstrack dimensions.

The term "width" will sometimes be used to refer to the crosstrack dimension of a receiving sheet or web and may be either the short or long dimension of the sheet.

U.S. Pat. No. 3,837,741 suggests the use of a constant current source for applying a voltage to a transfer roller that backs a receiving sheet to which a toner image is being transferred from an image member. A constant current source is also common in controlling the application of a transfer corona charger to the back of a receiving sheet in corona transfer systems. More specifically, the constant current source assures that a predetermined amount of charge will be applied to the material between the transfer roller or charger and the conductive backing for the image member, across the width of the roller or charger. This constant current source handles varying receiving sheet conditions while maintaining uniform transfer. A constant current source is very common in systems presently in use.

U.S. Pat. Nos. 5,036,360 to J. F. Paxon et al and 5,084,737, granted to Hagen et al Jan. 28, 1992, suggest that a measurement of potential applied by a constant current source can provide a measure of the resistance of a transfer member and, hence, a measure of ambient relative humidity. That measurement can then be used to adjust other aspects of the apparatus that perform variously in response to humidity changes.

Many modem copiers and printers automatically sense the size of the receiving sheets to which toner images are to be transferred. A logic and control in the apparatus uses this information to adjust many parameters in operation of the apparatus. For example, it can be used to magnify automatically an image to fit the sheet. It also can be used to adjust fusing devices to prevent a buildup of oil in portions of the fuser not used and to heat only the portion touching the sheet.

The dimensions of a receiving sheet can also be input by sensing notches on a cartridge in which the sheets are supplied to the machine or by ordinary operator input at a control panel.

It is also known to monitor the humidity associated with an electrophotographic apparatus to control various stations that are affected by it.

SUMMARY OF THE INVENTION

We have observed that the quality of images produced by certain electrophotographic devices varies somewhat according to the width of the receiving sheet being used. In analysis, we concluded this was due to width dependent variations in the effect of a constant current source applied to transfer. The amount of the variation appears to be affected by relative humidity, the thickness of the receiving sheet, and the type of receiver, e.g., bond paper or transparency stock. It is an object of the invention to reduce the effect of such variability.

This and other objects are accomplished by an image forming apparatus constructed according to claim 1.

According to a preferred embodiment, the image forming apparatus includes an image member on which toner images are formed (or to which they have been transferred) and a transfer station at which images are transferred from the image member to a receiving sheet as controlled by a logic and control. The transfer station includes either a transfer backing member positioned to receive a receiving sheet between it and the image member or a corona source for spraying corona on the back of a receiving sheet on the image member. An adjustable constant current source is coupled to the backing member or the corona source. It applies a constant current that creates an electrical field urging transfer of a toner image from the image member to the receiving sheet. A logic and control for the apparatus includes means for receiving an input indicative of the width of the receiving sheet and for adjusting the current produced by the constant current source in response thereto.

According to a preferred embodiment, a roller or web backing member forms a nip with the image member. The constant current source is applied to it. A well controlled constant current source attempts to distribute a constant amount of total charge across a backing member if the image and receiving sheet impedance is uniform. Further, a backing member with relatively high electrical resistance can help partially overcome the effects of variations in image and receiving sheet impedance. However, if the receiving sheet coming through the transfer station does not fully cover the backing member, a portion of the charge is distributed to the image member directly in the area not covered by the receiver sheet. We have found that more charge is distributed to the image member per unit of width than to the receiving sheet. We believe this is because there is a larger potential difference between the roller and the image member than between the roller and the receiver. As a result, the receiving sheet gets less charge per unit of width when it is narrower than it does when it is wider. A high resistance backing member cannot completely overcome this effect. Thus, according to a preferred embodiment, the current applied by the constant current source is increased as the width of the sheet is reduced. The same basic effect is seen using corona transfer.

According to another preferred embodiment, the backing member or corona source can be made adjustable to apply the field only over the width of the receiving sheet, for example, by segmenting the backing roller across the path of the image member.

The magnitude of the effect is also a function of the resistance of the receiving sheet which, in turn, is a function of relative humidity. If the receiving sheet is paper in a high relative humidity environment, the effect is considerably less pronounced than if the receiving sheet is transparency stock in any environment or paper in a relatively low humidity environment. The thickness of the receiving sheet also affects its resistance. Thus, according to a further preferred embodiment, the extent of the adjustment is varied according to the resistance of the receiving sheet. This can be accomplished by sensing the resistance of the receiving sheet prior to transfer or by calculating it knowing other parameters. For example, if the thickness of the receiving sheet and the relative humidity are known, the resistance of the receiving sheet can be calculated or determined from a look-up table and the field application adjusted for width accordingly.

According to another preferred embodiment, if one type of paper is used a very large percentage of the time, the effect of relative humidity can be read by monitoring the voltage associated with the constant current source. The current applied by the constant current source is then adjusted according to sheet width and that monitored voltage.

All of the parameters discussed above can be measured in the apparatus, some of them with more difficulty and complexity than others. Alternatively, they all can be input by an operator with appropriate prompts. Some of them can be input by sensing appropriate notches on a cartridge in which receiving sheets are supplied.

DETAILED DESCRIPTION OF THE INVENTION

The invention is particularly usable in an image forming apparatus in which a toner image is formed electrostatically and transferred to a receiving sheet. Most such devices are electrophotographic in nature. In this case, the image member is usually photoconductive (although the invention can also be used to transfer a toner image from an intermediate, nonphotoconductive image member to a receiving sheet). A photoconductive image member is uniformly charged and imagewise exposed to create an electrostatic image. The electrostatic image is toned with the application of fine charged toner particles to create a toner image. The toner image is transferred to a receiving sheet, usually by the application of an electrostatic field of a direction urging the particles to move from the image member to a receiving sheet that is positioned adjacent the image member. The field can be created by a bias applied to a transfer backing member for the receiving sheet (as will be explained with respect to FIG. 1). The backing member is generally a roller, but could be a film ski or other such device. It can also be created by spraying corona on the back of the receiving sheet (as will be explained with respect to FIG. 2). A conductive portion of the image member is generally grounded so that the bias applied to the backing member or the corona controls the field.

Figure 1:
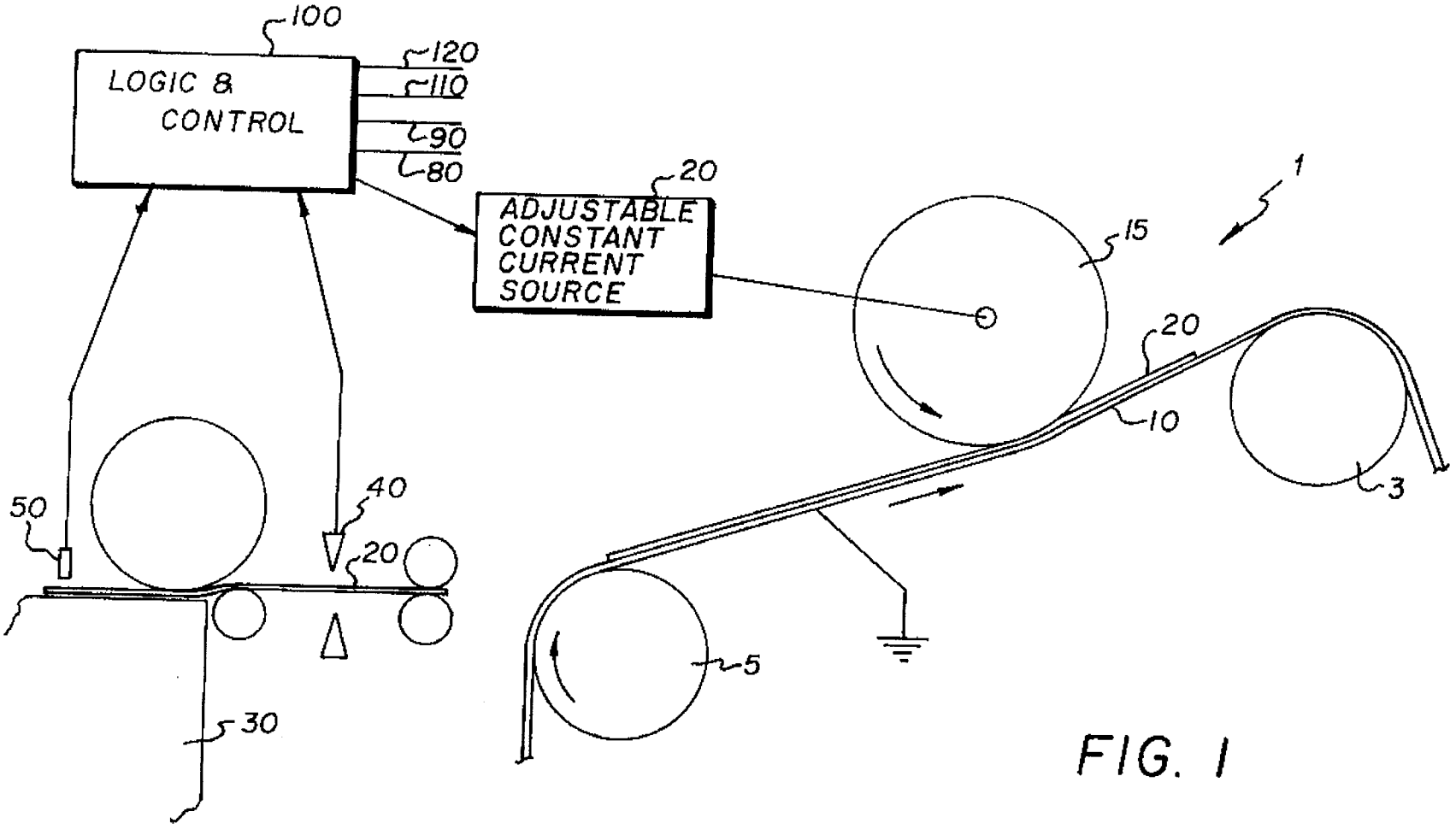
FIGS. 1 and 2 are side schematics and FIGS. 3 and 4 are top schematics of alternative transfer portions of an image forming apparatus.

Referring to FIG. 1, an image member 10, which carries a toner image formed electrophotographically or otherwise, is passed around a series of rollers, of which rollers 3 and 5 are shown. A backing member, for example, a backing roller 15, is positioned to engage the image member 10 and form with it a transfer station 1. It is also known to create a transfer station in which the backing member 15 is slightly separated from the image member and transfer is conducted across a small gap.

A receiving sheet 20 is fed from a receiving sheet supply 30 into engagement with image member 10 overlying a toner image and, hence, into a nip formed by image member 10 and backing roller 15. An adjustable constant current power supply or source 70 applies a constant current bias to backing roller 15 to create a field in the nip of a direction urging the charged toner particles to transfer from the image member 10 to the receiving sheet 20. After transfer, the receiving sheet 20 is separated from the image member 10 and transported to a fuser (not shown) where the toner image is fixed to the receiving sheet.

A logic and control 100 controls the process including the current applied by adjustable constant current source 70. Typical of most such logic and control devices, it receives substantial information about the dimension of the receiving sheet, including its width, which is shown input at 80.

If a receiving sheet, having a width less than the effective length of backing roller 15, is fed through transfer station 1, the amount of charge applied to the sheet per unit of width will vary according to its width. This is because, although the total amount of charge applied by the roller 15 is made constant by the constant current source, a greater amount will follow a path directly to image member 10 outside the edge of the sheet than will be deposited on the sheet itself.

According to one embodiment of the invention, this is corrected by varying the current applied by the constant current source according to the width of the sheet. That is, as the width of the sheet becomes less, the amount of current applied by the constant current source 70 is increased. Since logic and control 100 knows the paper width for other functions, this is readily accomplished. Note that the paper width can be input by the operator as shown at 80, it can be sensed in the supply tray by a sensor 50, or it can be input from notches on a cartridge, not shown.

The magnitude of this phenomenon is affected by the resistance of the receiving sheet. Thus, the characteristic is more severe dealing with high resistance receiving sheets such as paper in a dry environment or most transparency stock than for paper in a moist environment. If the apparatus is to be run strictly with a particular weight and type of paper, and if the relative humidity is constant, an adjustment for width alone would be adequate. However, further precision and flexibility can be obtained if an adjustment for the resistance of the sheet is also included in the equation. This can be accomplished directly using a sensor 40 which senses the resistance of the sheet and feeds that into the logic and control 100. The higher the resistance of the sheet, the greater the adjustment in the current applied by constant current source 70 for changes in width.

However, devices for sensing the resistance of paper or transparency stock are generally quite expensive. Accordingly, in some applications, it is preferred to estimate the resistance of the receiving sheet using other more available inputs. For example, the relative humidity can be input as shown at 90. If the thickness of the receiving sheet and the type of sheet (paper or transparency) are also known (as input at 110 and 120), these parameters can be used to determine the resistance and, with the width, appropriately adjust constant current source 70. Note that the thickness of the paper can be input from a notch on a cartridge, measured by a thickness sensor, input by the operator, or assumed to be a standard. Alternatively, the existence of a transparency material as compared with opaque material, presumed to be paper, can be readily determined optically by devices already in use in such apparatus. An adjustment based on the resistance of these two materials can be made with such an approximation. Depending on the apparatus use and environment, less than all of the above inputs may be sufficient because the others may not be expected to vary.

Using a feature of the prior art, the relative humidity can be determined by monitoring the voltage applied by the constant current source 70 with a typical backing member that has a resistance that varies with humidity.

The extent to which the constant current source should be adjusted for changes in width and in receiving sheet resistance can be determined empirically or calculated from known electrical formulas. The following table shows preferred currents in microamps for various widths of both 20 pound bond paper and 110 pound index paper that provide consistent transfer in a dry environment. Paper in a high humidity environment, for example, 75° F. and 75 percent relative humidity, is relatively unaffected by variations in width. However, drier paper, for example, paper conditioned at 70° F. and 50 percent relative humidity required the following current settings in microamps for consistent results:

| | Paper Width (in) | | |
|---|---|---|---|
| | 8.5 | 11 | 14 |
| 20 lb. bond | 75 | 69 | 62 |
| 110 lb. index | 88 | 77 | 63 |

The above results were achieved at a process speed of 53.3 cm/s. The roller had a length of 36.8 cm. The roller included a blanket with a resistivity of $1.4\times10^9$ ohm-cm and a thickness of 6.4 mm. The current applied with all widths of moist paper and for both weights of 14 inch dry paper is the same (62 or 63 microamps). Only when the paper width becomes less does the drier and thicker paper require special attention. Thus, width is an important parameter and its effect is magnified by the extra resistance of the dry 110 pound, thicker material.

Figure 2:
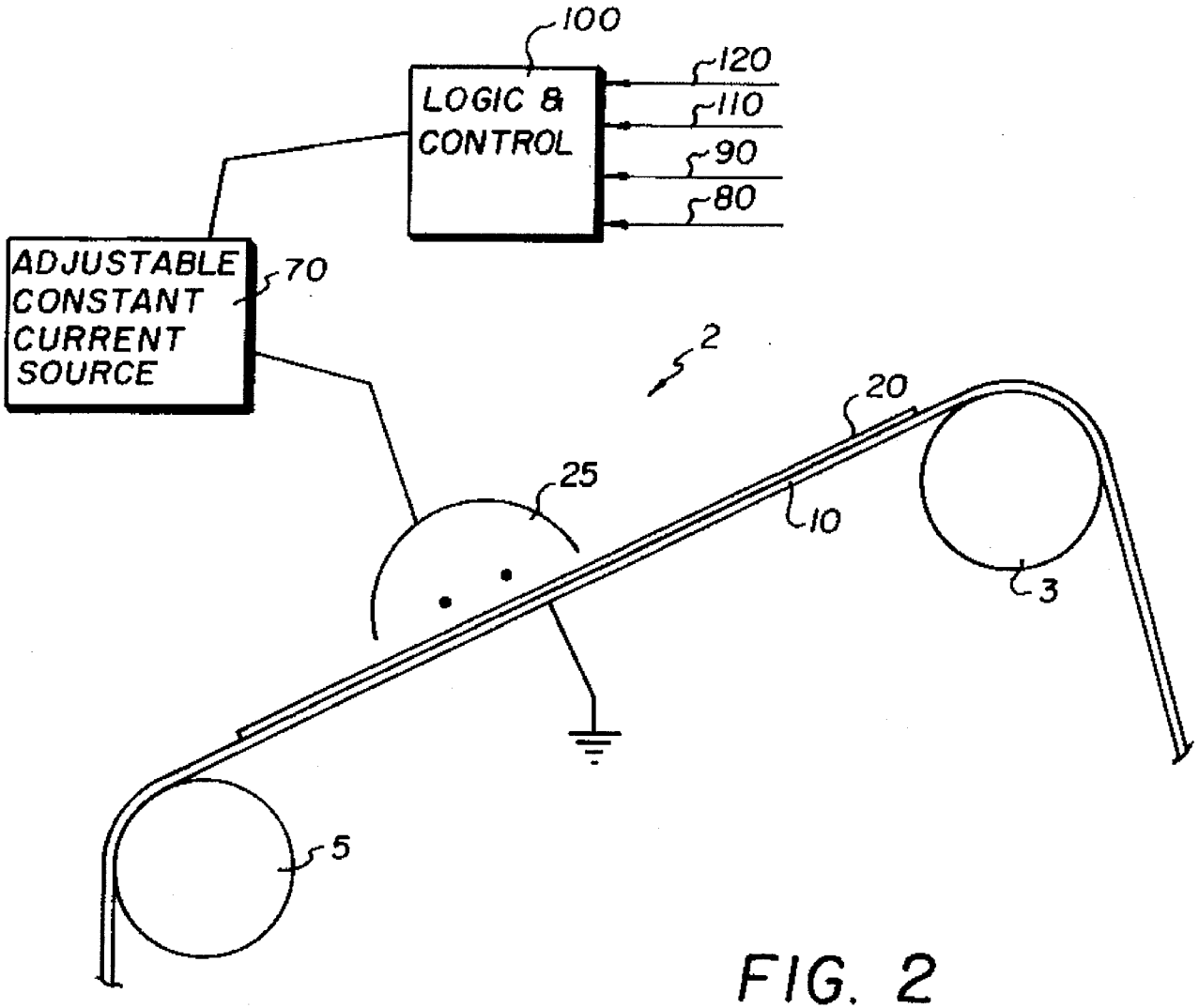

The invention is also usable in a corona transfer system. As shown in FIG. 2, a corona transfer station 2 includes a corona applying device, for example, a gridless corona charger 25 which sprays corona on the back of sheet 20 to create the transfer field with grounded image member 10. A constant current power supply or source 70 is also used to power charger 25 because it is less sensitive than would be a constant voltage source to environmental and sheet thickness variations.

We have found when using such a corona charger and power supply for transfer, more charge is distributed to the image member per unit of width than to the receiving sheet. The effect is similar to the previously described effect found when using a roller and a constant current source for transfer. We believe the cause is a larger potential difference between the corona wire and the image member than between the corona wire and the receiver. Thus, source 70 is adjusted to provide a higher current with a less wide, high resistance receiving sheet. The inputs are comparable to those in the first embodiment.

With the invention, consistent transfer can be attained in drier environments. Higher resistance material, such as transparency stock also benefits from the invention, whether or not the environment is moist or dry. Although the invention has been shown with respect to a web image member (which can be a photoconductor or an intermediate) in an electrophotographic machine, it can also be used with a drum image member and in an apparatus whose toner image is obtained other than electrophotographically, for example, by selective charge deposition or xeroprinting.

Figure 3:
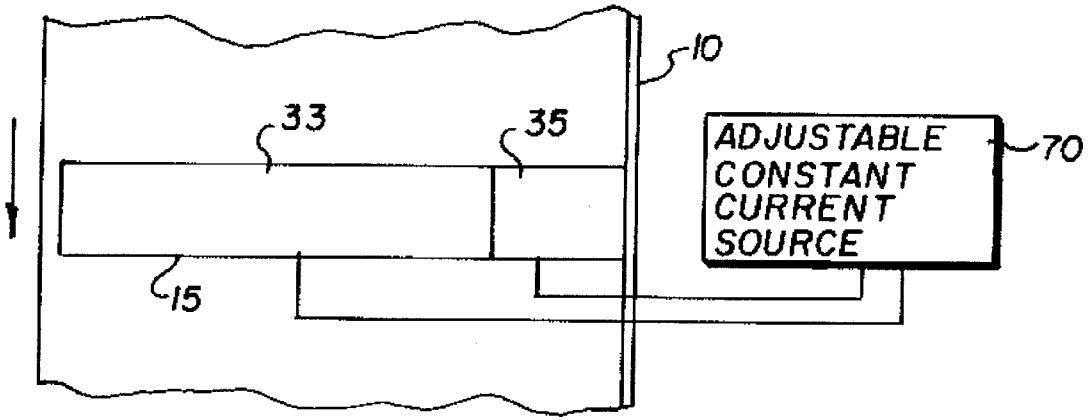
Figure 4:
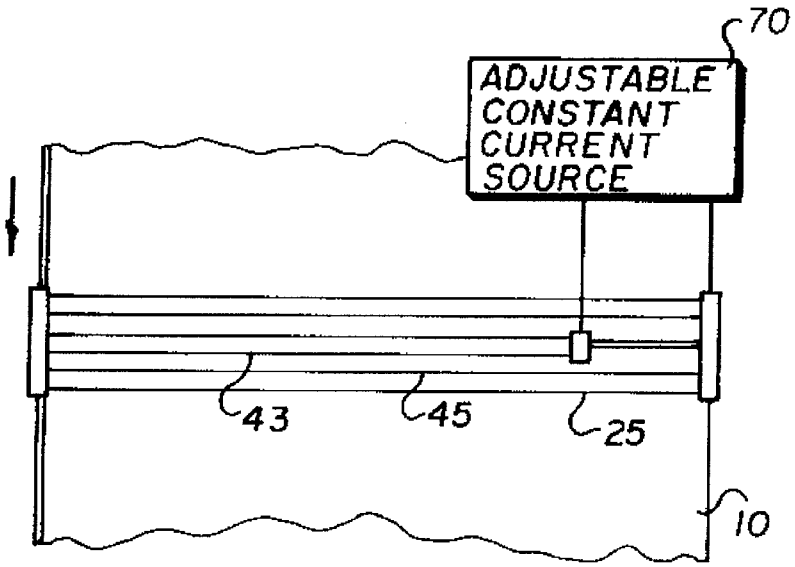

Although adjustment of the current of a constant current source is a simple and straightforward approach to solving the problem described, other, more involved, approaches can be used. For example, either backing member 15 or corona charger 25 could be mechanically altered to apply its field only over the receiver in question. Referring to FIG. 3, backing member 15 is divided into segments 33 and 35 across the path of image member 10. Source 70 then applies a constant current to either just segment 33 or both segments 33 and 35, depending on the width of the receiving sheet. The source is adjusted to apply a constant current density across the receiver whatever its width. Similarly, according to FIG. 4, corona wires 43 are on for letter size receiving sheets and wires 45 are on for legal size with source 70 adjusted appropriately. Although considerably more mechanically complex, a similar result is achieved to the FIGS. 1 and 2 approaches.

The invention has been described in detail with particular reference to a preferred embodiment thereof, but it will be understood that variations and modifications can be effected within the spirit and scope of the invention as described hereinabove and as defined in the appended claims.

We claim:

1. An image forming apparatus comprising an image member for carrying a toner image through a path, a transfer station along the path at which a toner image is transferred from the image member to a receiving sheet and a logic and control, wherein said transfer station includes a backing member or corona applying device, said backing member or device and image member being positioned to receive a receiving sheet having a width between them, and means coupled to the backing member or device for creating an electric field urging transfer of a toner image from the image member to the receiving sheet; and said logic and control includes means for receiving separate inputs indicative of the width of the receiving sheet and of the resistivity of the receiving sheet and means for adjusting application of the field according to both said width and said resistivity of the receiving sheet.

2. An image forming apparatus comprising an image member for carrying a toner image, a transfer station at which a toner image is transferred from the image member to a receiving sheet and a logic and control, wherein said transfer station includes a backing member or corona applying device, said backing member or device and image member being positioned to receive a receiving sheet having a width between them, and an adjustable constant current source coupled to the backing member or device to apply a constant current that creates an electric field urging transfer of a toner image from the image member to the receiving sheet; and said logic and control includes means for receiving separate inputs indicative of the width of the receiving sheet and of the resistivity of the receiving sheet and for adjusting the current produced by the constant current source according to both said width and said resistivity of the receiving sheet.

3. An image forming apparatus according to claim 2 wherein the logic and control includes means for applying an algorithm to said inputs to determine the current to be applied by the constant current source and wherein said algorithm determines the width of the receiving sheet and, if the width is the maximum width for the image forming apparatus, does not vary the current applied by the constant current source regardless of resistivity of the receiving sheet.

4. An image forming apparatus according to claim 2 wherein said logic and control includes means for varying the constant current source according to an algorithm depending upon the width and the resistivity of the receiving sheet, which algorithm determines whether the resistivity is below a particular level and if the resistivity is below that level does not adjust the constant current source regardless of the width.

5. An image forming apparatus according to claim 2 wherein the input of resistivity is determined from an input of the ambient relative humidity, the thickness of the receiving sheet, and/or the type of receiving sheet.

6. An image forming apparatus according to claim 2 wherein the transfer station includes a backing roller which forms a transfer nip with the image member into which a receiving sheet is fed.

7. An image forming apparatus according to claim 2 wherein the transfer station includes a gridless corona charger to which the constant current source is coupled.

8. An image forming apparatus comprising an image member for carrying a toner image through a path, a transfer station along the path at which a toner image is transferred from the image member to a receiving sheet and a logic and control, wherein said transfer station includes:

a backing roller which forms a transfer nip with the image member into which a receiving sheet having a width is fed, said backing roller being electrically segmented across the path of the image member, and means coupled to the backing roller for creating an electric field urging transfer of a toner image from the image member to the receiving sheets; and said logic and control includes means for receiving an input indicative of the width of the receiving sheet and means for adjusting application of the field in response to the width of the receiving sheet by applying the electric field using electrical segments of the backing roller corresponding to the input width.

9. An image forming apparatus comprising an image member for carrying a toner image through a path, a transfer station along the path in which a toner image is transferred from the image member to a receiving sheet and a logic and control, wherein said transfer station includes:

a gridless corona charger positioned to receive a receiving sheet having a width between the corona charger and the image member, and which corona charger is adjustable to supply corona across more than one portion of the path of the image member, and means coupled to the corona charger for creating an electric field urging transfer of a toner image from the image member to the receiving sheet; and said logic and control includes means for receiving an input indicative of the width of the receiving sheet and means for adjusting application of the field in response to said width of the receiving sheet by applying the corona across that portion of the path corresponding to the input width of the receiving sheet.

* * * * *